US011867433B2

(12) United States Patent
Shimoyama et al.

(10) Patent No.: US 11,867,433 B2
(45) Date of Patent: Jan. 9, 2024

(54) TEMPERATURE REGULATION DEVICE AND TEMPERATURE REGULATION METHOD

(71) Applicant: KELK Ltd., Kanagawa (JP)

(72) Inventors: Kouhei Shimoyama, Kanagawa (JP); Koji Maeda, Kanagawa (JP); Masato Horikoshi, Kanagawa (JP); Tomomi Nakazato, Kanagawa (JP)

(73) Assignee: KELK Ltd., Kanagawa (JP)

( * ) Notice: Subject to any disclaimer, the term of this patent is extended or adjusted under 35 U.S.C. 154(b) by 255 days.

(21) Appl. No.: 17/371,447

(22) Filed: Jul. 9, 2021

(65) Prior Publication Data

US 2022/0018578 A1 Jan. 20, 2022

(30) Foreign Application Priority Data

Jul. 16, 2020 (JP) ..... 2020-122270

(51) Int. Cl.
*F25B 21/02* (2006.01)

(52) U.S. Cl.
CPC ..... *F25B 21/02* (2013.01); *F25B 2321/0252* (2013.01)

(58) Field of Classification Search
CPC ..... F25B 21/02; F25B 2321/0252; F25B 2321/0212; F25B 21/04
See application file for complete search history.

(56) References Cited

U.S. PATENT DOCUMENTS

2019/0296206 A1* 9/2019 Kemp ..... H10N 10/17

FOREIGN PATENT DOCUMENTS

CN 201014077 Y * 1/2008
JP 2001-134324 A 5/2001

* cited by examiner

*Primary Examiner* — Ana M Vazquez
(74) *Attorney, Agent, or Firm* — Fish & Richardson P.C.

(57) ABSTRACT

A temperature regulation device includes: a first temperature regulation unit that regulates a temperature of a liquid; and a second temperature regulation unit that regulates a temperature of the liquid supplied from the first temperature regulation unit. The first temperature regulation unit includes: a first flow path module having a first flow path of the liquid; and a base module that regulates a temperature of the liquid of the first flow path. The second temperature regulation unit includes: a second flow path module having a second flow path in which the liquid from the first flow path flows; and a Peltier module that regulates a temperature of the liquid of the second flow path. The base module regulates a temperature of the Peltier module.

8 Claims, 9 Drawing Sheets

FIG.9

| | EMBODIMENT | EXAMPLE OF KNOWN ART |
|---|---|---|
| REGULATABLE TEMPERATURE RANGE | -40℃ TO +170℃ | -50℃ TO +130℃ |
| REGULATABLE TEMPERATURE RESOLUTION | FIRST TEMPERATURE REGULATION UNIT: ±1°C SECOND TEMPERATURE REGULATION UNIT: ±0.1°C | - |
| PELTIER MODULE TEMPERATURE | -20℃ TO +150℃ | -10℃ TO +80℃ |
| PELTIER MODULE TEMPERATURE DIFFERENCE | Δ20℃ | Δ40℃ TO Δ50℃ |

TEMPERATURE REGULATION DEVICE AND TEMPERATURE REGULATION METHOD

CROSS-REFERENCE TO RELATED APPLICATION(S)

The present application claims priority to and incorporates by reference the entire contents of Japanese Patent Application No. 2020-122270 filed in Japan on Jul. 16, 2020.

BACKGROUND OF THE INVENTION

1. Field of the Invention

The present disclosure relates to a temperature regulation device and a temperature regulation method.

2. Description of the Related Art

The semiconductor device manufacturing process uses a temperature regulation device that regulates the temperature of a temperature regulation target. JP 2001-134324 A discloses a temperature regulation system that sets a semiconductor wafer to a set temperature.

A temperature regulation device uses a Peltier module in some cases. The temperature resolution regulatable by the Peltier module is high. The Peltier module can regulate the temperature of a temperature regulation target with high accuracy. On the other hand, the temperature range regulatable by the Peltier module is narrow. The temperature difference between the heat absorption side and the heat emission side, at which the Peltier module's capabilities are efficiently exhibited, is substantially determined. This makes it difficult for the Peltier module to regulate the temperature of the temperature regulation target over a wide temperature range. Furthermore, an increase in the temperature difference between the heat absorption side and the heat emission side of the Peltier module would increase the thermal stress acting on the Peltier module, leading to the deterioration of the durability of the Peltier module. The deterioration of the durability of the Peltier module would make it difficult for the Peltier module to maintain highly accurate temperature regulation of the temperature regulation target.

SUMMARY OF THE INVENTION

It is an object of the present invention to at least partially solve the problems in the conventional technology.

According to an embodiment of the present invention, a temperature regulation device comprises: a first temperature regulation unit that regulates a temperature of a liquid; and a second temperature regulation unit that regulates a temperature of the liquid supplied from the first temperature regulation unit, wherein the first temperature regulation unit includes a first flow path module having a first flow path of the liquid and a base module that regulates a temperature of the liquid of the first flow path, the second temperature regulation unit includes a second flow path module having a second flow path in which the liquid from the first flow path flows and a Peltier module that regulates a temperature of the liquid of the second flow path, and the base module regulates a temperature of the Peltier module.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9 is a diagram illustrating the performance of the temperature regulation device according to the embodiment.

DETAILED DESCRIPTION OF THE PREFERRED EMBODIMENTS

Hereinafter, embodiments according to the present disclosure will be described with reference to the drawings, but the present disclosure is not limited to the embodiments. The constituents described in the embodiments below can be appropriately combined with each other. In some cases, a portion of the constituents is not utilized.

In an embodiment, a three-dimensional Cartesian coordinate system is set in a temperature regulation device, and the positional relationship of individual components will be described with reference to the three-dimensional Cartesian coordinate system. A direction parallel to the X-axis in a predetermined plane is defined as an X-axis direction. A direction parallel to the Y-axis orthogonal to the X-axis in a predetermined plane is defined as a Y-axis direction. A direction parallel to the Z-axis orthogonal to the X-axis and the Y-axis each is defined as a Z-axis direction. In the embodiment, the X-axis direction corresponds to a first direction. The plane including the X-axis and the Y-axis is defined as an XY plane. The predetermined plane described above is the XY plane. The Z-axis is orthogonal to the XY plane. In the embodiment, the Z-axis direction is the vertical direction. The XY plane is parallel to the horizontal plane.

Cleaning System

Figure 1:
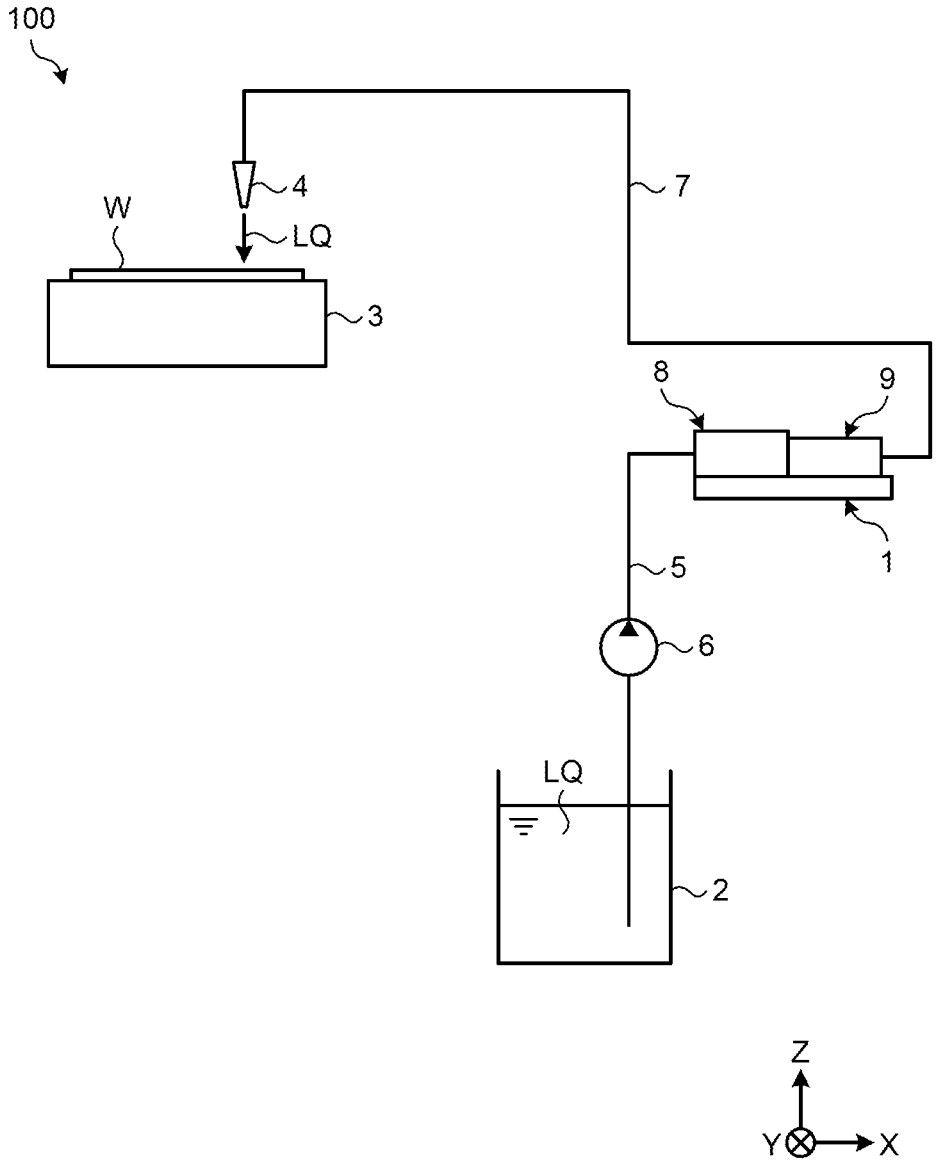
FIG. 1 is a diagram schematically illustrating a cleaning system according to an embodiment.

FIG. 1 is a diagram schematically illustrating a cleaning system 100 according to the embodiment. The cleaning system 100 cleans a substrate W as a cleaning target using a liquid LQ as a cleaning liquid. An example of the substrate W is a semiconductor wafer. The substrate W may be a glass substrate, for example. The cleaning system 100 includes a temperature regulation device 1 that regulates the temperature of the liquid LQ. The cleaning system 100 cleans the substrate W using the liquid LQ whose temperature has been regulated by the temperature regulation device 1.

The cleaning system 100 includes the temperature regulation device 1, a storage tank 2, a substrate holding member 3, a nozzle 4, a first connection tube 5, a pump 6, and a second connection tube 7.

The storage tank 2 stores the liquid LQ. The substrate holding member 3 holds the substrate W. The nozzle 4 supplies the liquid LQ whose temperature has been regulated by the temperature regulation device 1 to the substrate W. The first connection tube 5 connects the storage tank 2 and the temperature regulation device 1 with each other. The pump 6 is disposed in the first connection tube 5. The second connection tube 7 connects the temperature regulation device 1 and the nozzle 4 with each other. With actuation of the pump 6, at least a part of the liquid LQ in the storage tank 2 is supplied to the temperature regulation device 1 via the first connection tube 5. The temperature regulation device 1 regulates the temperature of the liquid LQ supplied from the storage tank 2 via the first connection tube 5. The liquid LQ whose temperature has been regulated by the temperature regulation device 1 is supplied to the nozzle 4 via the second connection tube 7. The nozzle 4 supplies the liquid LQ to the substrate W. With the liquid LQ supplied to the substrate W, the substrate W is cleaned.

Temperature Regulation Device

Figure 2:
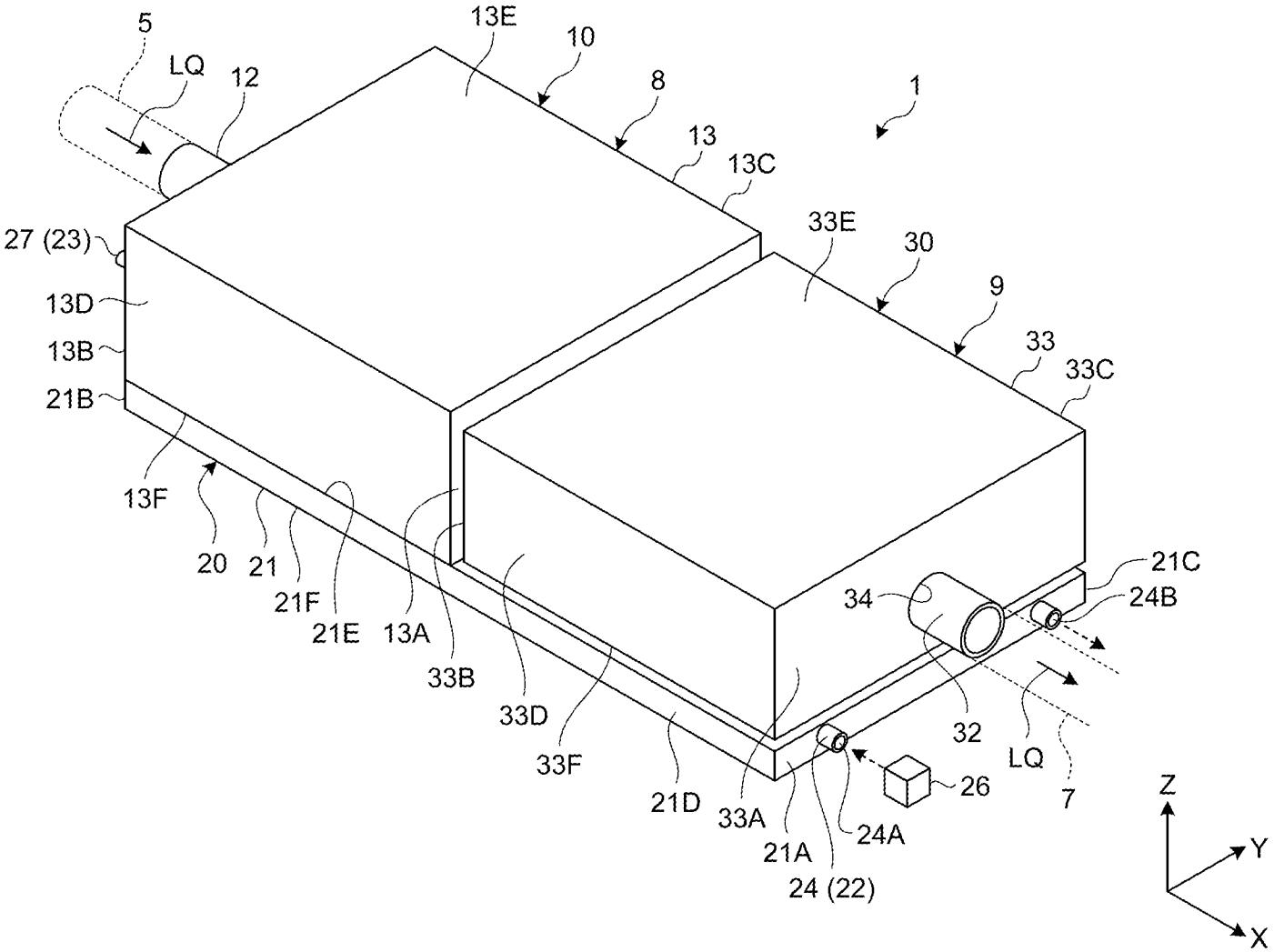
FIG. 2 is a top perspective view illustrating a temperature regulation device according to the embodiment.
Figure 3:
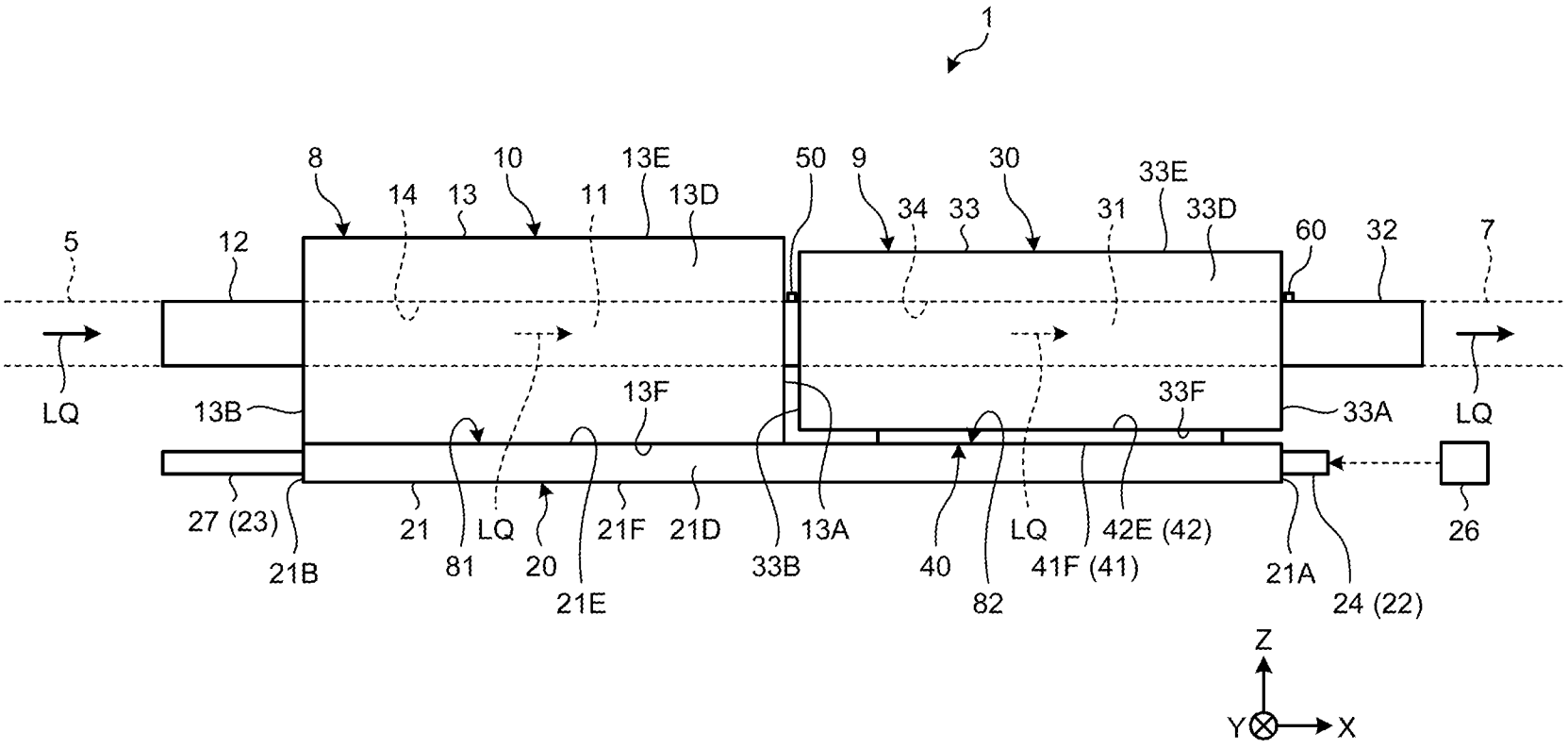
FIG. 3 is a side view illustrating the temperature regulation device according to the embodiment.

FIG. 2 is a top perspective view illustrating the temperature regulation device 1 according to the embodiment. FIG. 3 is a side view illustrating the temperature regulation device 1 according to the embodiment.

As illustrated in FIGS. 2 and 3, the temperature regulation device 1 includes a first temperature regulation unit 8, a second temperature regulation unit 9, a first temperature sensor 50, and a second temperature sensor 60.

The first temperature regulation unit 8 regulates the temperature of the liquid LQ supplied from the first connection tube 5. The first temperature regulation unit 8 is referred to as a rough temperature regulation unit. The liquid LQ whose temperature has been regulated by the first temperature regulation unit 8 is supplied to the second temperature regulation unit 9.

The second temperature regulation unit 9 regulates the temperature of the liquid LQ supplied from the first temperature regulation unit 8. The second temperature regulation unit 9 is referred to as a fine temperature regulation unit. The second temperature regulation unit 9 can regulate the temperature of the liquid LQ with higher accuracy than the first temperature regulation unit 8. The liquid LQ whose temperature has been regulated by the second temperature regulation unit 9 is supplied to the nozzle 4 via the second connection tube 7.

First Temperature Regulation Unit

Figure 4:
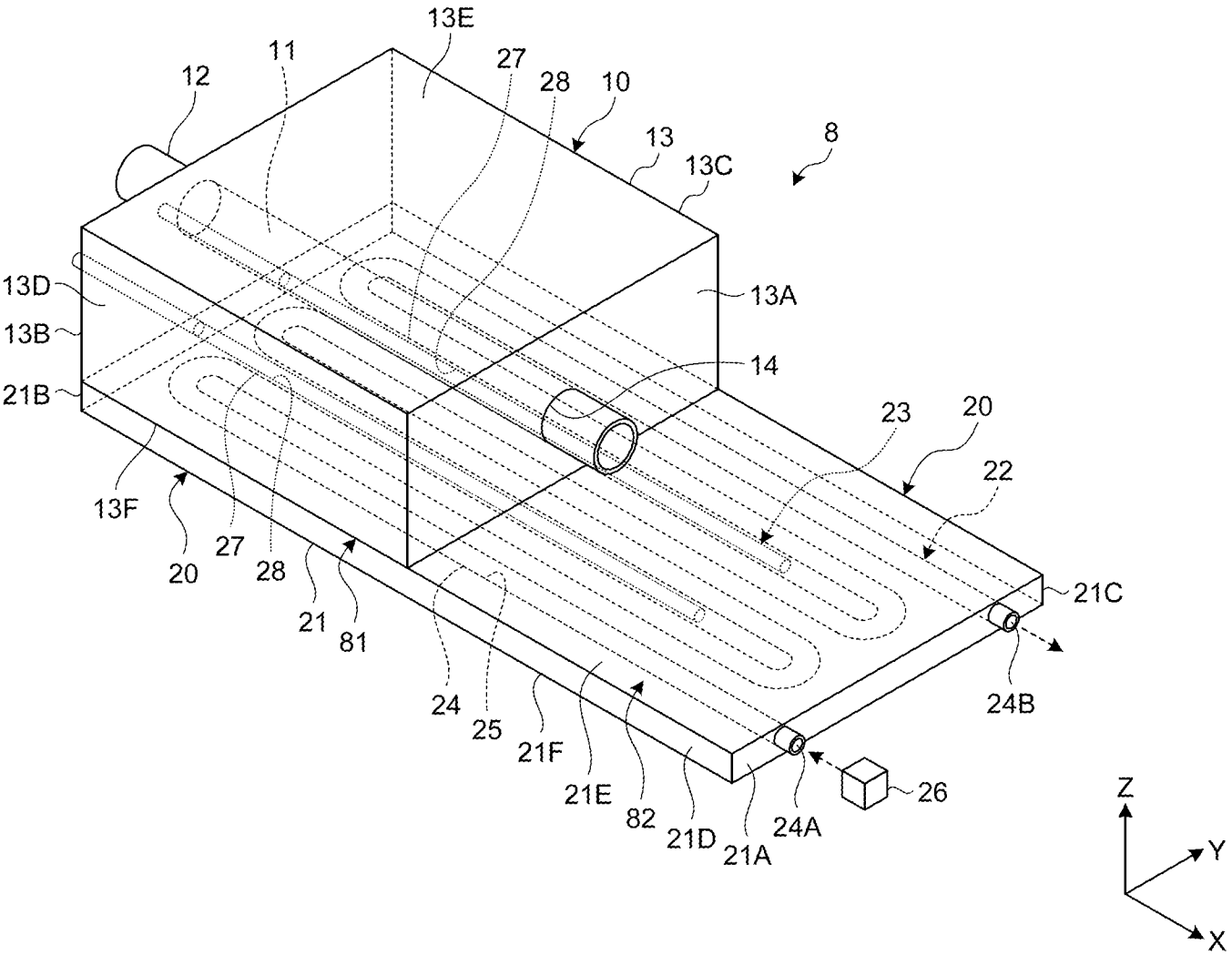
FIG. 4 is a top perspective view illustrating a first temperature regulation unit according to the embodiment.

FIG. 4 is a top perspective view illustrating the first temperature regulation unit 8 according to the embodiment. As illustrated in FIGS. 2, 3 and 4, the first temperature regulation unit 8 includes: a first flow path module 10 having a first flow path 11 of the liquid LQ; and a base module 20 that regulates the temperature of the liquid LQ of the first flow path 11.

The first flow path module 10 includes: a first tube 12 having the first flow path 11; and a first support 13 disposed around the first tube 12.

The first tube 12 is formed of a synthetic resin containing a fluoropolymer as a main component. In the embodiment, the first tube 12 is formed of perfluoroalkoxy alkane (PFA). The first tube 12 may be formed of polytetrafluoroethylene (PTFE) or polyvinylidene difluoride (PVDF). The first flow path 11 is an internal flow path of the first tube 12.

The first tube 12 is connected to the first connection tube 5. The liquid LQ from an internal flow path of the first connection tube 5 flows into the first flow path 11. The liquid LQ is supplied from the internal flow path of the first connection tube 5 to the first flow path 11.

The first support 13 is formed of metal. The first support 13 is a block-shaped metal member. In the embodiment, the first support 13 is formed of copper (Cu). The first support 13 may be formed of aluminum (Al). The outer shape of the first support 13 is a rectangular parallelepiped shape. The surface of the first support 13 includes: a front surface 13A oriented in the +X direction, a rear surface 13B oriented in the −X direction, a left surface 13C oriented in the +Y direction, a right surface 13D oriented in the −Y direction, a top surface 13E oriented in the +Z direction, and a bottom surface 13F oriented in the −Z direction.

The first support 13 has a hole 14 in which the first tube 12 is disposed. The hole 14 is formed inside the first support 13. The hole 14 is formed so as to penetrate through the front surface 13A and the rear surface 13B of the first support 13. The first tube 12 has a straight shape. The inner surface of the hole 14 comes in contact with the outer surface of the first tube 12. The first flow path 11 extends in the X-axis direction (first direction).

The base module 20 includes a base support 21, as well as a cooling unit 22 and a heating unit 23 disposed inside the base support 21.

The base support 21 is formed of metal. The base support 21 is a plate-shaped metal member. In the embodiment, the base support 21 is formed of copper (Cu). The base support 21 may be formed of aluminum (Al). The outer shape of the base support 21 is a rectangular parallelepiped shape. The surface of the base support 21 includes: a front surface 21A oriented in the +X direction, a rear surface 21B oriented in the −X direction, a left surface 21C oriented in the +Y direction, a right surface 21D oriented in the −Y direction, a top surface 21E oriented in the +Z direction, and a bottom surface 21F oriented in the −Z direction.

The cooling unit 22 cools the liquid LQ of the first flow path 11. In the embodiment, the cooling unit 22 includes a refrigerant tube 24 disposed inside the base support 21. The base support 21 has a hole 25 in which the refrigerant tube 24 is disposed. The hole 25 is formed so as to bend inside the base support 21. The inner surface of the hole 25 comes in contact with the outer surface of the refrigerant tube 24. The refrigerant tube 24 includes a plurality of bent portions and a plurality of straight portions connected to the bent portions. The base module 20 includes a refrigerant supply device 26 that supplies a refrigerant to the refrigerant tube 24. Examples of the refrigerant include water, ethylene glycol, and Fluorinert (trademarked brand name). The refrigerant supply device 26 is connected to an inlet 24A of the refrigerant tube 24. The inlet 24A is disposed on the front surface 21A of the base support 21. The refrigerant delivered from the refrigerant supply device 26 flows into the internal flow path of the refrigerant tube 24 via the inlet 24A. The refrigerant flowing through the internal flow path of the refrigerant tube 24 flows out of an outlet 24B of the refrigerant tube 24. The outlet 24B is disposed on the front surface 21A of the base support 21. The refrigerant flowing out of the outlet 24B is returned to the refrigerant supply device 26.

The heating unit 23 heats the liquid LQ of the first flow path 11. In the embodiment, the heating unit 23 includes a cartridge heater 27 disposed inside the base support 21. The base support 21 has a hole 28 in which the cartridge heater 27 is disposed. The hole 28 is formed so as to extend in the +X direction from an end surface on the −X side of the base support 21. The inner surface of the hole 28 comes in contact with the outer surface of the cartridge heater 27.

Second Temperature Regulation Unit

Figure 5:
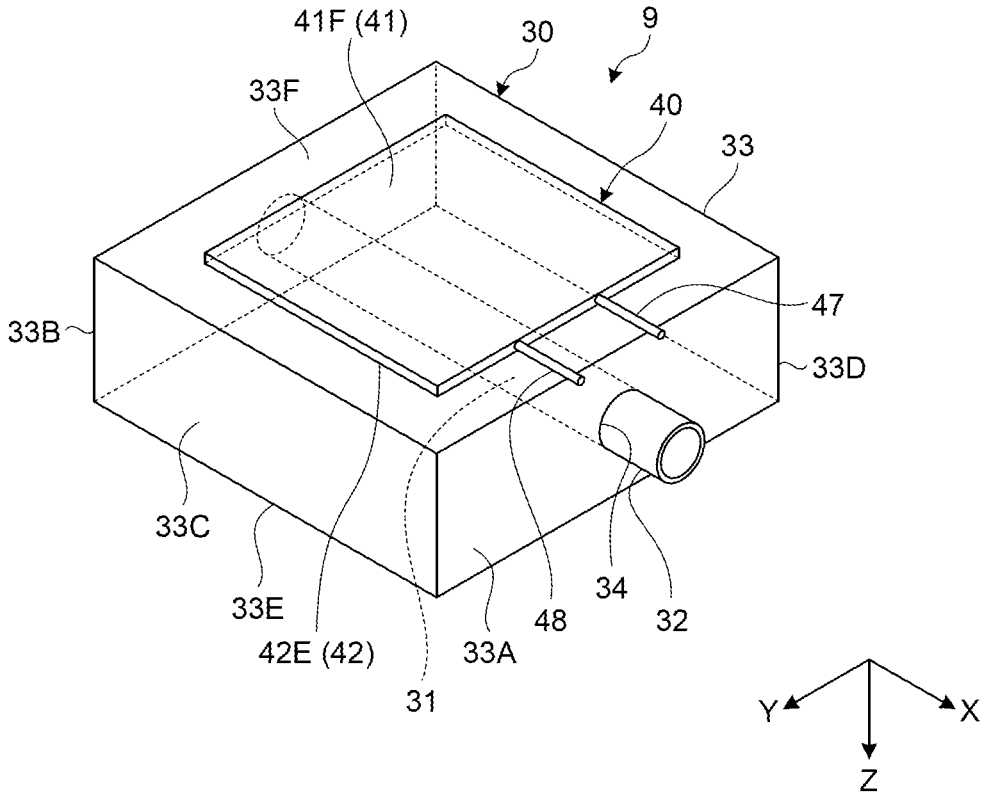
FIG. 5 is a bottom perspective view illustrating a second temperature regulation unit according to the embodiment.

FIG. 5 is a bottom perspective view illustrating the second temperature regulation unit 9 according to the embodiment. As illustrated in FIGS. 2, 3, and 5, the second temperature regulation unit 9 includes: a second flow path module 30 having a second flow path 31 of the liquid LQ; and a Peltier module 40 that regulates the temperature of the liquid LQ of the second flow path 31.

The second flow path module 30 includes: a second tube 32 having the second flow path 31; and a second support 33 disposed around the second tube 32.

The second tube 32 is formed of a synthetic resin containing a fluoropolymer as a main component. In the embodiment, the second tube 32 is formed of perfluoroalkoxy alkane (PFA). The second tube 32 may be formed of polytetrafluoroethylene (PTFE) or polyvinylidene difluoride (PVDF). The second flow path 31 is an internal flow path of the second tube 32.

The second tube 32 is connected to the first tube 12. The liquid LQ from the first flow path 11 flows into the second flow path 31. The liquid LQ is supplied from the first flow path 11 to the second flow path 31.

The second tube 32 is connected to the second connection tube 7. The liquid LQ from the second flow path 31 flows into an internal flow path of the second connection tube 7. The liquid LQ is supplied from the second flow path 31 to the internal flow path of the second connection tube 7.

The second support 33 is formed of metal. The second support 33 is a block-shaped metal member. In the embodiment, the second support 33 is formed of copper (Cu).

The second support 33 may be formed of aluminum (Al). The outer shape of the second support 33 is a rectangular parallelepiped shape. The surface of the second support 33 includes: a front surface 33A oriented in the +X direction, a rear surface 33B oriented in the −X direction, a left surface 33C oriented in the +Y direction, a right surface 33D oriented in the −Y direction, a top surface 33E oriented in the +Z direction, and a bottom surface 33F oriented in the −Z direction.

The second support 33 has a hole 34 in which the second tube 32 is disposed. The hole 34 is formed inside the second support 33. The hole 34 is formed so as to penetrate through the front surface 33A and the rear surface 33B of the second support 33. The second tube 32 has a straight shape. The inner surface of the hole 34 comes in contact with the outer surface of the second tube 32. The second flow path 31 extends in the X-axis direction (first direction).

Figure 6:
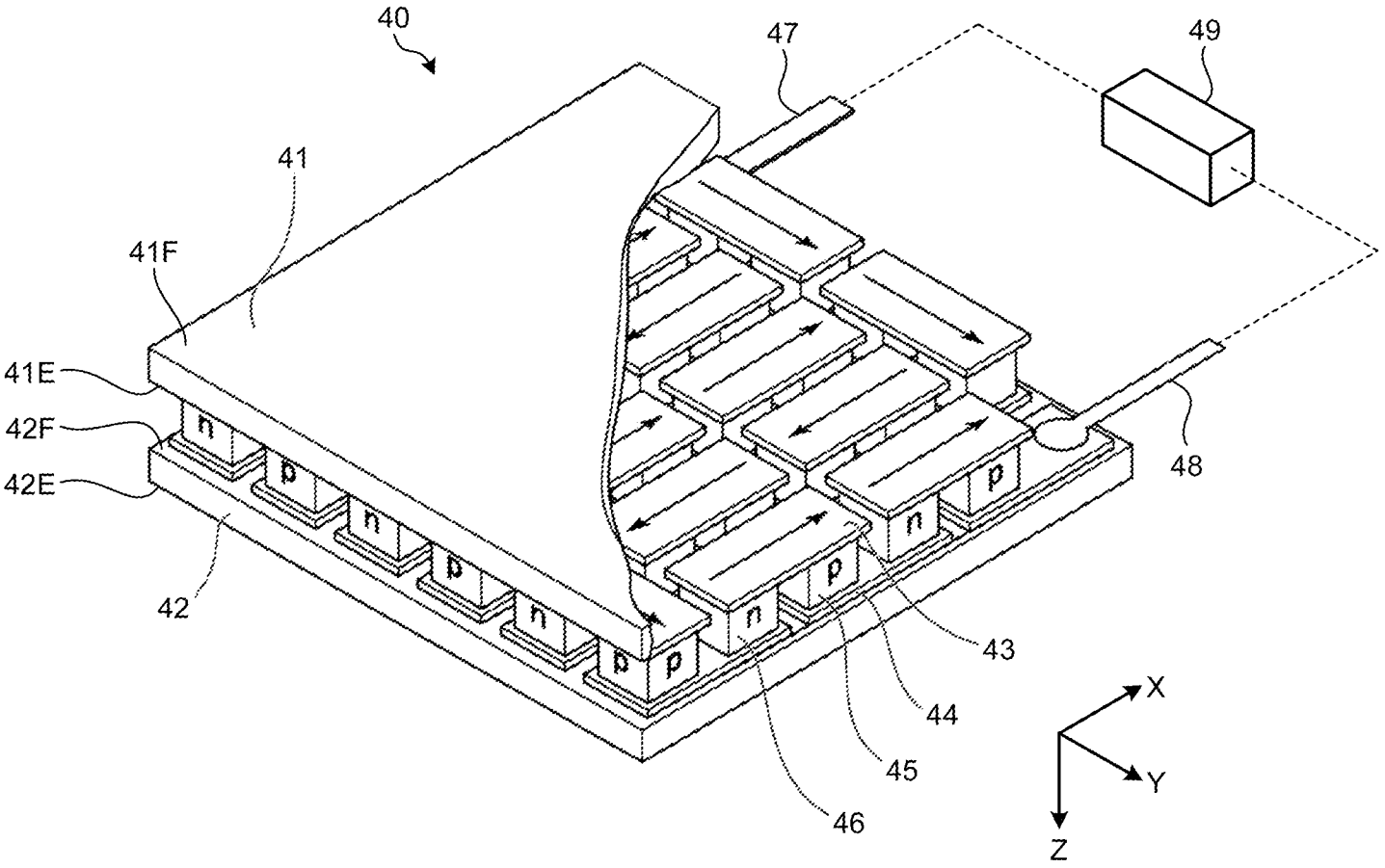
FIG. 6 is a perspective view illustrating a Peltier module according to the embodiment.

FIG. 6 is a perspective view illustrating the Peltier module 40 according to the embodiment. As illustrated in FIG. 6, the Peltier module 40 includes: a first substrate 41 and a second substrate 42; a first electrode 43 and a second electrode 44; and a thermoelectric element 45 and a thermoelectric element 46 disposed between the first electrode 43 and the second electrode 44.

The first substrate 41 and the second substrate 42 are each formed of an electrically insulating material. In the embodiment, each of the first substrate 41 and the second substrate 42 is a ceramic substrate. The first substrate 41 and the second substrate 42 are each formed of an oxide ceramic or a nitride ceramic. Examples of the oxide ceramic include aluminum oxide ($Al_2O_3$) and zirconium oxide ($ZrO_2$). Examples of the nitride ceramic include silicon nitride ($Si_3N_4$) and aluminum nitride (AlN).

The surface of the first substrate 41 includes a top surface 41E oriented in the +Z direction and a bottom surface 41F oriented in the −Z direction. The surface of the second substrate 42 includes a top surface 42E oriented in the +Z direction and a bottom surface 42F oriented in the −Z direction. The first substrate 41 is disposed on the −Z side of the second substrate 42. The top surface 41E of the first substrate 41 and the bottom surface 42F of the second substrate 42 face each other with a gap.

The first electrode 43 is disposed on the top surface 41E of the first substrate 41. The second electrode 44 is disposed on the bottom surface 42F of the second substrate 42. The first electrode 43 is disposed in plurality in an XY plane parallel to the top surface 41E of the first substrate 41. The second electrode 44 is disposed in plurality in an XY plane parallel to the bottom surface 42F of the second substrate 42.

The thermoelectric element 45 and the thermoelectric element 46 are each formed of a thermoelectric material. The thermoelectric element 45 is a p-type thermoelectric semiconductor element. The thermoelectric element 46 is an n-type thermoelectric semiconductor element. The thermoelectric element 45 and the thermoelectric element 46 are each disposed in plurality in the XY plane. In the X-axis direction, the thermoelectric elements 45 and the thermoelectric elements 46 are disposed alternately. In the Y-axis direction, the thermoelectric elements 45 and the thermoelectric elements 46 are disposed alternately.

The first electrode 43 is connected individually to the thermoelectric elements 45 and the thermoelectric elements 46, which are adjacent to each other in pairs. The second electrode 44 is connected individually to the thermoelectric elements 45 and the thermoelectric elements 46, which are adjacent to each other in pairs. The bottom surface of the thermoelectric element 45 and the bottom surface of the thermoelectric element 46 are each connected to the first electrode 43. The top surface of the thermoelectric element 45 and the top surface of the thermoelectric element 46 are each connected to the second electrode 44.

Electrically connecting the thermoelectric element 45 and the thermoelectric element 46 via the first electrode 43 or the second electrode 44 will form a pn element pair. Connecting a plurality of the pn element pairs in series via the second electrode 44 or the first electrode 43 will form a series circuit. The thermoelectric element 46 at one end of the series circuit is connected with a lead wire 47 via the second electrode 44. The thermoelectric element 45 at the other end of the series circuit is connected with a lead wire 48 via the second electrode 44. The Peltier module 40 includes a power supply device 49 that provides a potential difference between the first electrode 43 and the second electrode 44. The lead wire 47 and the lead wire 48 are each connected to the power supply device 49.

When a potential difference is applied between the first electrode 43 and the second electrode 44, the Peltier module 40 absorbs heat or emits heat due to the Peltier effect. When a potential difference is applied between the first electrode 43 and the second electrode 44, electric charges move in the thermoelectric element 45 and the thermoelectric element 46, allowing the current to flow. Along with the movement of the electric charges, heat is transferred in the thermoelectric element 45 and the thermoelectric element 46. This allows the Peltier module 40 to absorb heat or emit heat.

The bottom surface 41F of the first substrate 41 functions as one surface out of a heat absorbing surface and a heat emitting surface of the Peltier module 40. The top surface 42E of the second substrate 42 functions as the other surface out of the heat absorbing surface and the heat emitting surface of the Peltier module 40.

Relationship between First Temperature Regulation Unit and Second Temperature Regulation Unit The bottom surface 41F of the first substrate 41 of the Peltier module 40 comes in contact with at least a part of the surface of the base module 20. In the embodiment, the bottom surface 41F of the first substrate 41 comes in contact with the top surface 21E of the base support 21.

The top surface 42E of the second substrate 42 of the Peltier module 40 comes in contact with at least a part of the surface of the second flow path module 30. In the embodiment, the top surface 42E of the second substrate 42 comes in contact with the bottom surface 33F of the second support 33.

The first flow path module 10 is disposed so as to come in contact with at least a part of the surface of the base module 20. In the embodiment, the bottom surface 13F of the first support 13 comes in contact with at least a part of the top surface 21E of the base support 21. The first flow path module 10 is disposed so as to come in contact with a first region 81 of the top surface 21E of the base module 20.

The Peltier module 40 is disposed so as to come in contact with at least a part of the surface of the base module 20. In the embodiment, the bottom surface 41F of the first substrate 41 comes in contact with at least a part of the top surface 21E of the base support 21. The Peltier module 40 is disposed so as to come in contact with a second region 82, which is provided on the top surface 21E of the base module 20 and is adjacent to the first region 81.

The first region 81 in which the first flow path module 10 is disposed and the second region 82 in which the Peltier module 40 is disposed are adjacent to each other in the X-axis direction (first direction). The first flow path module 10 and the Peltier module 40 are disposed in the X-axis direction (first direction). The first flow path module 10 and the second flow path module 30 are disposed in the X-axis direction (first direction). The Peltier module 40 is disposed on the +X side of the first flow path module 10. The second flow path module 30 is disposed on the +X side of the first flow path module 10.

The first flow path module 10 is disposed on the +Z side of the base module 20. The Peltier module 40 is disposed on the +Z side of the base module 20 on the +X side of the first flow path module 10. The second flow path module 30 is disposed on the +Z side of the Peltier module 40. The front surface 13A of the first support 13 and the rear surface 33B of the second support 33 face each other. The front surface 13A of the first support 13 and the rear surface 33B of the second support 33 may come in contact with each other or may be separated from each other.

First Temperature Sensor

The first temperature sensor 50 detects the temperature of the liquid LQ whose temperature has been regulated by the first temperature regulation unit 8. The first temperature sensor 50 is disposed between an outlet of the first flow path 11 and an inlet of the second flow path 31. The first temperature sensor 50 detects the temperature referred to as an outlet temperature of the liquid LQ of the first temperature regulation unit 8.

Second Temperature Sensor

The second temperature sensor 60 detects the temperature of the liquid LQ whose temperature has been regulated by the second temperature regulation unit 9. The second temperature sensor 60 is disposed between an outlet of the second flow path 31 and an inlet of the internal flow path of the second connection tube 7. The second temperature sensor 60 detects the temperature referred to as an outlet temperature of the liquid LQ of the second temperature regulation unit 9.

Control Unit

Figure 7:
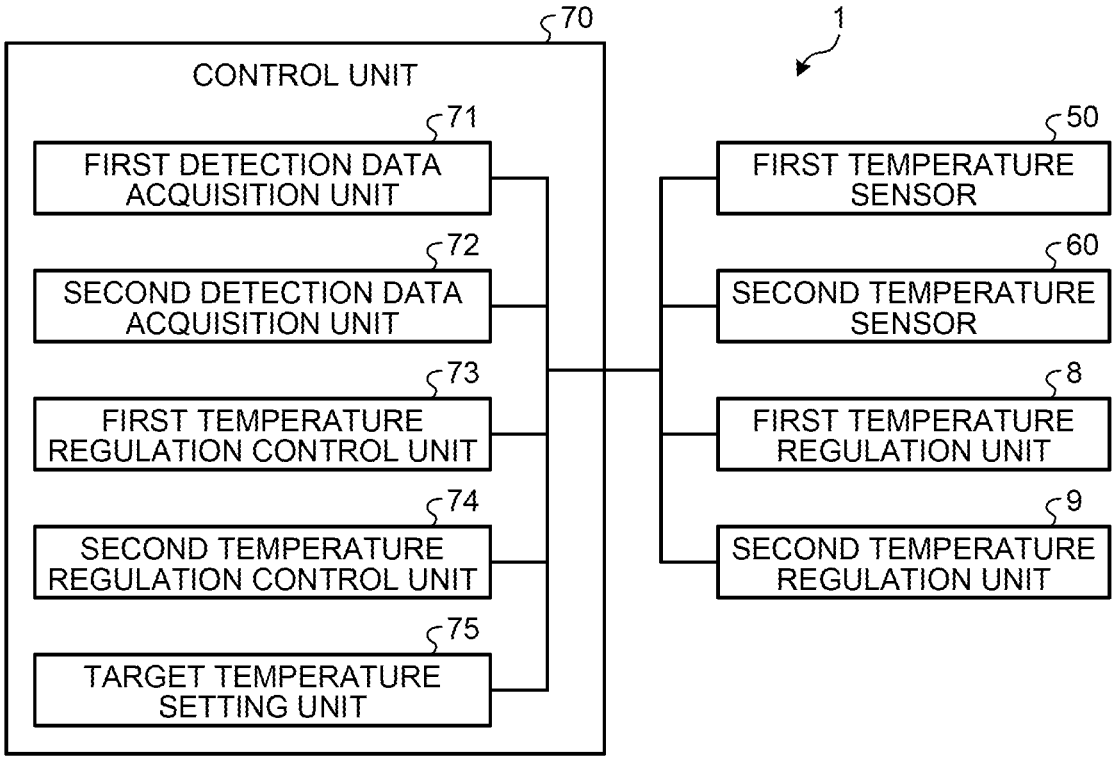
FIG. 7 is a functional block diagram illustrating the temperature regulation device according to the embodiment.

FIG. 7 is a functional block diagram illustrating the temperature regulation device 1 according to the embodiment. The temperature regulation device 1 includes a control unit 70. The control unit 70 includes a computer system. The control unit 70 controls the first temperature regulation unit 8 and the second temperature regulation unit 9.

Controlling the first temperature regulation unit 8 includes controlling the base module 20. Controlling the base module 20 includes controlling at least one of the cooling unit 22 or the heating unit 23.

Controlling the second temperature regulation unit 9 includes controlling the Peltier module 40. Controlling the Peltier module 40 includes controlling the power supply device 49. Controlling the power supply device 49 includes controlling the value and direction of the current flowing through the thermoelectric element 45 and the thermoelectric element 46.

The control unit 70 controls the first temperature regulation unit 8 based on the detection data of the first temperature sensor 50. The control unit 70 controls the second temperature regulation unit 9 based on the detection data of the second temperature sensor 60. The first temperature regulation unit 8 regulates the temperature of the liquid LQ flowing through the first flow path 11. The second temperature regulation unit 9 regulates the temperature of the liquid LQ flowing through the second flow path 31.

The control unit 70 includes a first detection data acquisition unit 71, a second detection data acquisition unit 72, a first temperature regulation control unit 73, a second temperature regulation control unit 74, and a target temperature setting unit 75.

The first detection data acquisition unit 71 acquires the detection data of the first temperature sensor 50. The second detection data acquisition unit 72 acquires the detection data of the second temperature sensor 60. The first temperature regulation control unit 73 outputs a control command for controlling the first temperature regulation unit 8 based on the detection data of the first temperature sensor 50 acquired by the first detection data acquisition unit 71. The second temperature regulation control unit 74 outputs a control command for controlling the second temperature regulation unit 9 based on the detection data of the second temperature sensor 60 acquired by the second detection data acquisition unit 72. The target temperature setting unit 75 sets the target temperature of the liquid LQ to be supplied to the nozzle 4.

The first temperature regulation control unit 73 controls the first temperature regulation unit 8 so that the outlet temperature of the liquid LQ of the first temperature regulation unit 8 is set to the target temperature based on the detection data of the first temperature sensor 50. When cooling the liquid LQ, the first temperature regulation control unit 73 outputs a control command to the refrigerant supply device 26 to control at least one of the temperature or the flow rate of the refrigerant supplied from the refrigerant supply device 26 to the refrigerant tube 24. The liquid LQ flowing through the first flow path 11 is cooled by the base module 20. When heating the liquid LQ, the first temperature regulation control unit 73 outputs a control command to the cartridge heater 27 to control the temperature of the cartridge heater 27. The liquid LQ flowing through the first flow path 11 is heated by the base module 20.

The second temperature regulation control unit 74 controls the second temperature regulation unit 9 so that the outlet temperature of the liquid LQ of the second temperature regulation unit 9 is set to the target temperature based on the detection data of the second temperature sensor 60. When cooling the liquid LQ, the second temperature regulation control unit 74 outputs a control command to the power supply device 49 so that the first substrate 41 emits heat and the second substrate 42 absorbs heat. The power supply device 49 applies a potential difference between the first electrode 43 and the second electrode 44 to allow a current to flow through the thermoelectric element 45 and the thermoelectric element 46 so that the first substrate 41 emits heat and the second substrate 42 absorbs heat on the Peltier module 40. The liquid LQ flowing through the second flow path 31 is cooled by the Peltier module 40. When heating the liquid LQ, the second temperature regulation control unit 74 outputs a control command to the power supply device 49 so that the first substrate 41 absorbs heat and the second substrate 42 emits heat. The power supply device 49 applies a potential difference between the first electrode 43 and the second electrode 44 to allow a current to flow through the thermoelectric element 45 and the thermoelectric element 46 so that the first substrate 41 absorbs heat and the second substrate 42 emits heat on the Peltier module 40. The liquid LQ flowing through the second flow path 31 is heated by the Peltier module 40.

Temperature Regulation Method

Figure 8:
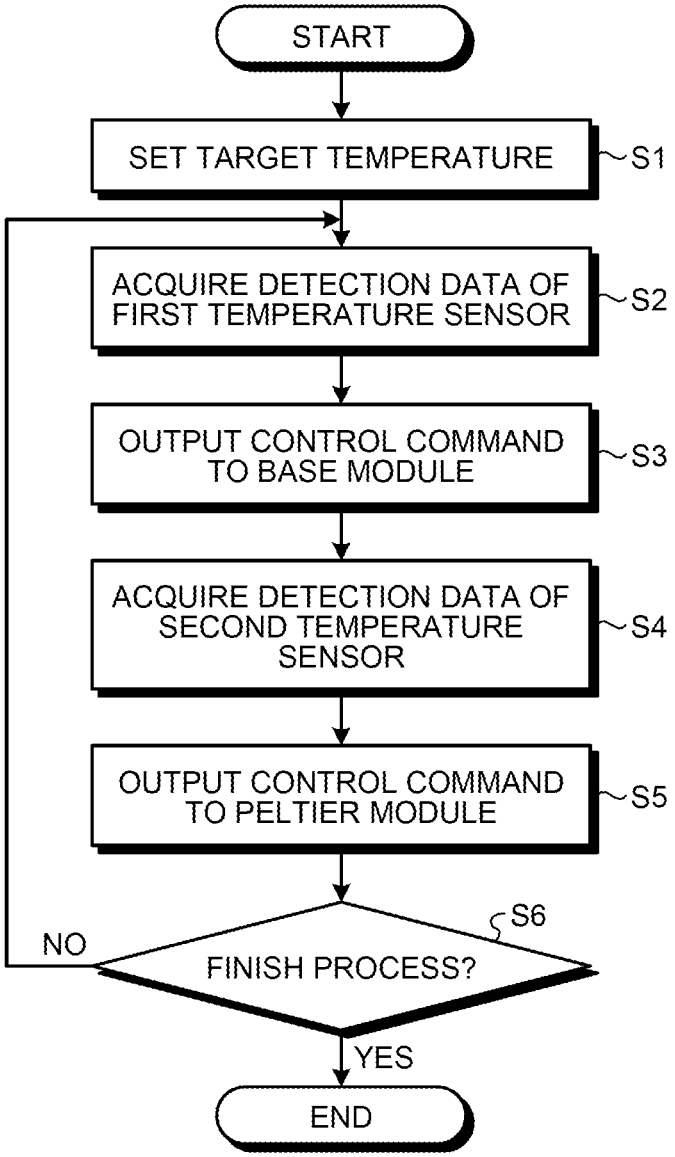
FIG. 8 is a flowchart illustrating a temperature regulation method according to the embodiment.

FIG. 8 is a flowchart illustrating a temperature regulation method according to the embodiment. The target temperature setting unit 75 sets a target temperature of the liquid LQ (step S1).

With actuation of the pump 6, the liquid LQ of the storage tank 2 is supplied to the temperature regulation device 1 via the internal flow path of the first connection tube 5. The liquid LQ flowing through the internal flow path of the first connection tube 5 flows into the first flow path 11 of the first temperature regulation unit 8. The liquid LQ flowing through the first flow path 11 flows into the second flow path 31 of the second temperature regulation unit 9. The liquid LQ flowing through the second flow path 31 is supplied to the nozzle 4 via the internal flow path of the second connection tube 7.

The outlet temperature of the liquid LQ of the first temperature regulation unit 8 is detected by the first temperature sensor 50. The detection data of the first temperature sensor 50 is output to the control unit 70. The first detection data acquisition unit 71 acquires the detection data of the first temperature sensor 50 (step S2).

The first temperature regulation control unit 73 outputs a control command to the base module 20 so that the outlet temperature of the liquid LQ of the first temperature regulation unit 8 is set to the target temperature based on the detection data of the first temperature sensor 50 (step S3).

With the control command output to the base module 20, the temperature of the liquid LQ flowing through the first flow path 11 is regulated by the base module 20. The liquid LQ whose temperature has been regulated by the base module 20 is supplied from the first flow path 11 to the second flow path 31 of the second temperature regulation unit 9.

The outlet temperature of the liquid LQ of the second temperature regulation unit 9 is detected by the second temperature sensor 60. The detection data of the second temperature sensor 60 is output to the control unit 70. The second detection data acquisition unit 72 acquires the detection data of the second temperature sensor 60 (step S4).

Based on the detection data of the second temperature sensor 60, the second temperature regulation control unit 74 outputs a control command to the Peltier module 40 so that the outlet temperature of the liquid LQ of the second temperature regulation unit 9 is set to the target temperature (step S5).

The first temperature regulation control unit 73 determines whether to end the process of regulating the temperature of the liquid LQ (step S6).

When determined in step S6 that the process of regulating the temperature of the liquid LQ is not to be finished (step S6: No), the first temperature regulation control unit 73 returns to the process of step S2. When determined in step S6 that the process of regulating the temperature of the liquid LQ is to be finished (step S6: Yes), the first temperature regulation control unit 73 finishes the process of regulating the temperature of the liquid LQ.

With the control command output to the Peltier module 40, the temperature of the liquid LQ flowing through the second flow path 31 is regulated by the Peltier module 40. The liquid LQ whose temperature has been regulated by the Peltier module 40 is supplied to the nozzle 4 via the internal flow path of the second connection tube 7. The liquid LQ supplied to the nozzle 4 is supplied to the substrate W held by the substrate holding member 3. The substrate W is cleaned with the liquid LQ whose temperature has been regulated by the temperature regulation device 1.

In regulating the temperature of the liquid LQ, the base module 20 of the first temperature regulation unit 8 regulates the temperature of the Peltier module 40. The base module 20 regulates the temperature of the Peltier module 40 in parallel with regulating the temperature of the liquid LQ of the first flow path module 10. The bottom surface 41F of the Peltier module 40 comes in contact with the top surface 21E of the base module 20. Regulating the temperature of the base module 20 will regulate the temperature of the bottom surface 41F of the Peltier module 40.

The first temperature regulation control unit 73 controls the base module 20 so that the liquid LQ of the first flow path module 10 is set to the target temperature. That is, the first temperature regulation control unit 73 controls at least one of the cooling unit 22 or the heating unit 23 of the base module 20 so that the top surface 21E of the base module 20 comes closer to the target temperature of the liquid LQ. This reduces the difference between the temperature of the bottom surface 41F of the Peltier module 40 and the target temperature of the liquid LQ. That is, the temperature of the bottom surface 41F of the Peltier module 40 comes closer to the target temperature of the liquid LQ.

The second temperature regulation control unit 74 controls the Peltier module 40 so that the liquid LQ of the second flow path module 30 is set to the target temperature in a state where the temperature of the bottom surface 41F of the Peltier module 40 is coming closer to the target temperature of the liquid LQ. This allows the Peltier module 40 to regulate the temperature of the liquid LQ of the second flow path module 30 with high accuracy.

The temperature range regulatable by the Peltier module 40 is narrow. Although the Peltier module 40 is capable of regulating the temperature of the liquid LQ with high accuracy in a low temperature range, it would be difficult to regulate the temperature of the liquid LQ with high accuracy in a high temperature range exceeding 130° C., for example. For example, when the target temperature of the liquid LQ is 140° C., it would be difficult to regulate the liquid LQ to the target temperature only with the Peltier module 40.

In the embodiment, the base module 20 brings the temperature of the bottom surface 41F of the Peltier module 40 closer to the target temperature of the liquid LQ. This allows the Peltier module 40 to regulate the temperature of the liquid LQ with high accuracy even in a high temperature range in which the target temperature of the liquid LQ exceeds 130° C. Furthermore, even when a temperature disturbance is input to the Peltier module 40, the temperature of the Peltier module 40 is regulated by the base module 20, enabling the second temperature regulation unit 9 to regulate the temperature of the liquid LQ with high accuracy.

Effects

As described above, according to the embodiment, the temperature of the liquid LQ of the first flow path module 10 is regulated by the base module 20. The temperature of the liquid LQ of the second flow path module 30 is regulated by the Peltier module 40. The base module 20 regulates the temperature of the Peltier module 40 in parallel with regulating the temperature of the liquid LQ of the first flow path module 10. The Peltier module 40 regulates the temperature of the liquid LQ of the second flow path module 30 in a state where the temperature of the bottom surface 41F is coming closer to the target temperature of the liquid LQ. Therefore, the temperature regulation device 1 is capable of regulating the temperature of the liquid LQ with high accuracy over a wide temperature range. Furthermore, with the temperature of the Peltier module 40 regulated by the base module 20, the Peltier module 40 is capable of regulating the temperature of the liquid LQ in a state where the temperature difference between the bottom surface 41F coming in contact with the base module 20 and the top surface 42E coming in contact with the second flow path module 30 is maintained to a small value. This reduces the thermal stress acting on the Peltier module 40. With this configuration, the durability of the Peltier module 40 is improved as compared with the case where the temperature of the Peltier module 40 is not regulated by the base module 20.

FIG. 9 is a diagram illustrating the performance of the temperature regulation device 1 according to the embodiment. As illustrated in FIG. 9, the temperature regulation device 1 according to the embodiment is capable of regulating the temperature of the liquid LQ over a wide temperature range, that is, −40° C. or more and +170° C. or less, for example. In addition, the temperature resolution regulatable by the second temperature regulation unit 9 having the Peltier module 40 is as high as ±0.1° C. The temperature resolution regulatable by the first temperature regulation unit 8 is ±1° C. The temperature of the bottom surface 41F of the Peltier module 40 is regulated by the base module 20 in the range of −20° C. or more and +150° C. or less. Since the temperature difference between the bottom surface 41F and the top surface 42E of the Peltier module 40 can be reduced to 20° C. or less, it is possible to suppress the deterioration of the durability of the Peltier module 40. Furthermore, the temperature regulation device 1 according to the embodiment can implement both heating and cooling of the liquid LQ. An example of a known art illustrated in FIG. 9 illustrates the performance of the temperature regulation system disclosed in JP 2001-134324 A. As illustrated in FIG. 9, it can be seen that the temperature regulation device 1 according to the embodiment can regulate the temperature of the liquid LQ with high accuracy over a wider temperature range as compared with the example of the known art.

The bottom surface 41F of the Peltier module 40 comes in contact with at least a part of the top surface 21E of the base module 20. With this configuration, heat is smoothly transferred between the top surface 21E of the base module 20 and the bottom surface 41F of the Peltier module 40. This enables the base module 20 to smoothly regulate the temperature of the Peltier module 40.

The top surface 42E of the Peltier module 40 comes in contact with at least a part of the bottom surface 33F of the second flow path module 30. With this configuration, heat is smoothly transferred between the top surface 42E of the Peltier module 40 and the bottom surface 33F of the second flow path module 30. This enables the Peltier module 40 to smoothly regulate the temperature of the liquid LQ of the second flow path module 30.

The first flow path module 10 is disposed so as to come in contact with the first region 81 of the top surface 21E of the base module 20. The Peltier module 40 is disposed so as to come in contact with the second region 82, which is provided on the top surface 21E of the base module 20 and is adjacent to the first region 81. This makes it possible to suppress an increase in size of the temperature regulation device 1.

The first region 81 and the second region 82 are adjacent to each other in the X-axis direction (first direction). The first flow path 11 extends in the X-axis direction (first direction). The second flow path 31 extends in the X-axis direction (first direction). The first flow path module 10 and the second flow path module 30 are disposed in the X-axis direction (first direction). This forms the first flow path 11 and the second flow path 31 into a straight shape. This makes it possible to suppress an increase in a pressure loss of the liquid LQ flowing through the first flow path 11 and the second flow path 31. This also makes it possible to suppress an increase in size of the temperature regulation device 1.

The base module 20 includes the base support 21 formed of metal, as well as the cooling unit 22 and the heating unit 23 disposed inside the base support 21. Since the cooling unit 22 and the heating unit 23 are disposed inside the base support 21, the temperature of the top surface 21E of the base support 21 is regulated by at least one of the cooling unit 22 or the heating unit 23. Since the base support 21 is formed of metal having high thermal conductivity, the heat of at least one of the cooling unit 22 or the heating unit 23 is smoothly transferred to the top surface 21E of the base support 21.

In the embodiment, the base support 21 has the hole 25 in which the refrigerant tube 24 is disposed. The inner surface of the hole 25 comes in contact with the outer surface of the refrigerant tube 24. That is, the base support 21 is a solid material. With this configuration, the heat of the refrigerant in the refrigerant tube 24 is smoothly transferred to the top surface 21E of the base support 21 via the base support 21 formed of metal. Similarly, the base support 21 has the hole 28 in which the cartridge heater 27 is disposed. The inner surface of the hole 28 comes in contact with the outer surface of the cartridge heater 27. With this configuration, the heat of the cartridge heater 27 is smoothly transferred to the top surface 21E of the base support 21 via the base support 21 formed of metal.

The first flow path module 10 is formed of a synthetic resin containing a fluoropolymer as a main component, and includes: the first tube 12 having the first flow path 11; and the first support 13 formed of metal disposed around the first tube 12. Since the first tube 12 is formed of a synthetic resin containing a fluoropolymer as a main component, it is possible to suppress contamination of the liquid LQ flowing through the first flow path 11. Furthermore, since the first support 13 is formed of metal having high thermal conductivity, the heat of the base module 20 is smoothly transferred to the liquid LQ of the first flow path 11.

In the embodiment, the first support 13 has the hole 14 in which the first tube 12 is disposed. The inner surface of the hole 14 comes in contact with the outer surface of the first tube 12. That is, the first support 13 is a solid material. This allows the heat of the base module 20 to be smoothly transferred to the liquid LQ of the first flow path 11 via the first support 13 formed of metal.

The second flow path module 30 is formed of a synthetic resin containing fluoropolymer as a main component, and includes: the second tube 32 having the second flow path 31; and the second support 33 formed of metal disposed around the second tube 32. Since the second tube 32 is formed of a synthetic resin containing a fluoropolymer as a main component, it is possible to suppress contamination of the liquid LQ flowing through the second flow path 31.

Furthermore, since the second support 33 is formed of metal having high thermal conductivity, the heat of the Peltier module 40 is smoothly transferred to the liquid LQ of the second flow path 31.

In the embodiment, the second support 33 has the hole 34 in which the second tube 32 is disposed. The inner surface of the hole 34 comes in contact with the outer surface of the second tube 32. That is, the second support 33 is a solid material. This allows the heat of the Peltier module 40 to be transferred smoothly to the liquid LQ of the second flow path 31 via the second support 33 formed of metal.

Other Embodiments

The above embodiment is an exemplary case where the inner surface of the hole 14 comes in contact with the outer surface of the first tube 12. That is, the first support 13 is assumed to be a solid material. The inner surface of the hole 14 may be separated from the outer surface of the first tube 12. That is, the first support 13 may be a hollow material. When the first support 13 is a hollow material, the heat of the base module 20 is transferred to the inner surface of the hole 14 and thereafter transferred to the first tube 12 by radiant heat. Similarly, the second support 33 may be a hollow material. The base support 21 may be a hollow material.

The above-described embodiment is an exemplary case where the first support 13 and the base support 21 of the first temperature regulation unit 8 are separate members. The first support 13 and the base support 21 may be integrated (single member).

The above-described embodiment is an exemplary case where the cooling unit 22 includes the refrigerant tube 24 through which the refrigerant flows. The cooling unit 22 is not limited to the refrigerant tube 24 as long as it can cool the liquid LQ flowing through the first flow path 11 and can cool the Peltier module 40.

The above-described embodiment is an exemplary case where the heating unit 23 includes the cartridge heater 27. The heating unit 23 is not limited to the cartridge heater 27 as long as it has a capability of heating the liquid LQ flowing through the first flow path 11 and heating the Peltier module 40. The heating unit 23 may include a heating medium tube through which a heating medium flows, for example.

The above-described embodiment is an exemplary case where the second support 33 is formed of metal. The second support 33 may be formed of a synthetic resin containing a fluoropolymer as a main component. The second support 33 may be formed of polytetrafluoroethylene (PTFE), for example.

In the above-described embodiment, the first flow path 11 and the second flow path 31 are assumed to be connected in a straight shape. There may be a bent portion between the first flow path 11 and the second flow path 31.

In the above-described embodiment, the first temperature regulation unit 8 is assumed to include the base support 21. The base support 21 may be omitted. A part of a temperature regulation tube through which at least one of the refrigerant or the heating medium flows may be wound around the first tube 12, while another part of the temperature regulation tube may come in contact with the Peltier module 40.

In the above-described embodiment, the liquid LQ may be pure water or a chemical solution. Examples of the chemical solution include sulfuric acid hydrogen peroxide ($H_2SO_4$, $H_2O_2$), ammonia hydrogen peroxide ($NH_4OH$, $H_2O_2$, $H_2O$), hydrochloric acid hydrogen peroxide (HCl, $H_2O_2$, $H_2O$), and other organic chemical solutions.

The above-described embodiment is an exemplary case where the temperature regulation device 1 is applied to the cleaning system 100. The temperature regulation device 1 may be applied to an etching device, for example. The temperature regulation device 1 is used for regulating the temperature of at least a part of a semiconductor manufacturing device or the temperature of a liquid or gas used for manufacturing a semiconductor device. Examples of the liquid include brines such as Garden (registered trademark) or Fluorinert (trademarked brand name).

The above-described embodiment is an exemplary case where the temperature regulation device 1 regulates the temperature of the liquid LQ. The temperature regulation device 1 may regulate the temperature of a gas.

According to the present disclosure, it is possible to regulate the temperature of the liquid with high accuracy over a wide temperature range.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A temperature regulation device comprising:

a first temperature regulation unit that regulates a temperature of a liquid; and a second temperature regulation unit that regulates a temperature of the liquid supplied from the first temperature regulation unit, wherein the first temperature regulation unit includes a first flow path module having a first flow path of the liquid and a base module that regulates a temperature of the liquid of the first flow path, wherein the second temperature regulation unit includes a second flow path module having a second flow path in which the liquid from the first flow path flows and a Peltier module that regulates a temperature of the liquid of the second flow path, wherein the base module regulates a temperature of the Peltier module, wherein the first flow path module is disposed so as to come in contact with a first region of a surface of the base module, and wherein the Peltier module is disposed so as to come in contact with a second region of the surface of the base module, the second region being adjacent to the first region.

2. The temperature regulation device according to claim 1, wherein one of a heat absorbing surface and a heat emitting surface of the Peltier module comes in contact with at least a part of a surface of the base module.

3. The temperature regulation device according to claim 2, wherein the other of the heat absorbing surface and the heat emitting surface of the Peltier module comes in contact with at least a part of a surface of the second flow path module.

4. The temperature regulation device according to claim 1, wherein:

the first region and the second region are adjacent to each other in a first direction, the first flow path extends in the first direction, the second flow path extends in the first direction, and the first flow path module and the second flow path module are disposed in the first direction.

5. The temperature regulation device according to claim 1, wherein the first flow path module includes a first tube that is formed of a synthetic resin containing a fluoropolymer as a main component and that has the first flow path, and a first support formed of metal disposed around the first tube.

6. The temperature regulation device according to claim 1, wherein the second flow path module includes a second tube that is formed of a synthetic resin containing a fluoropolymer as a main component and that has the second flow path, and a second support formed of metal disposed around the second tube.

7. A temperature regulation device comprising:

a first temperature regulation unit that regulates a temperature of a liquid; and a second temperature regulation unit that regulates a temperature of the liquid supplied from the first temperature regulation unit, wherein the first temperature regulation unit includes a first flow path module having a first flow path of the liquid and a base module that regulates a temperature of the liquid of the first flow path, wherein the second temperature regulation unit includes a second flow path module having a second flow path in which the liquid from the first flow path flows and a Peltier module that regulates a temperature of the liquid of the second flow path, wherein the base module regulates a temperature of the Peltier module, and wherein the base module includes a base support formed of metal, as well as a cooling unit and a heating unit which are disposed inside the base support.

8. A temperature regulation method of a temperature regulation device, the temperature regulation device including a first temperature regulation unit that regulates a temperature of a liquid, and a second temperature regulation unit that regulates a temperature of the liquid supplied from the first temperature regulation unit, the temperature regulation method comprising:

regulating, by using a base module, a temperature of a liquid flowing through a first flow path;

regulating, by using a Peltier module, a temperature of the liquid that flows through a second flow path and that is supplied from the first flow path; and regulating, by using the base module, a temperature of the Peltier module, wherein the first temperature regulation unit includes a first flow path module having the first flow path of the liquid and the base module, wherein the second temperature regulation unit includes a second flow path module having the second flow path in which the liquid from the first flow path flows and the Peltier module that regulates the temperature of the liquid of the second flow path, wherein the first flow path module defines the first flow path and is disposed so as to come in contact with a first region of a surface of the base module, and wherein the Peltier module is disposed so as to come in contact with a second region of the surface of the base module, the second region being adjacent to the first region.

* * * * *